US006245443B1

(12) United States Patent
Shiue et al.

(10) Patent No.: US 6,245,443 B1
(45) Date of Patent: Jun. 12, 2001

(54) REMOVABLE BOND FOR ABRASIVE TOOL

(75) Inventors: Ren-Kae Shiue, Taipei (TW); Thomas W. Eagar, Belmont, MA (US); Bradley Miller, Westboro, MA (US); Sergej-Tomislav Buljan, Acton, MA (US)

(73) Assignee: Norton Company, Worcester, MA (US)

( * ) Notice: Subject to any disclaimer, the term of this patent is extended or adjusted under 35 U.S.C. 154(b) by 0 days.

(21) Appl. No.: 08/704,190

(22) Filed: Aug. 28, 1996

(51) Int. Cl.[7] ..... B32B 15/01; B32B 15/16; B32B 15/18; B32B 15/20

(52) U.S. Cl. ..... 428/615; 428/627; 428/681; 428/332; 428/676; 428/675; 51/295

(58) Field of Search ..... 420/417, 469, 420/470, 492, 557, 560, 587, 589; 428/546, 548, 551, 552, 553, 564, 615, 646, 647, 648, 668, 671, 660, 681, 675, 676, 627; 148/432, 433, 412, 516, 513, 514; 51/295, 297, 307, 309

(56) References Cited

U.S. PATENT DOCUMENTS

| | | | | |
|---|---|---|---|---|
| 3,178,273 | | 4/1965 | Libal | 51/293 |
| 3,869,259 | * | 3/1975 | Lindsey | 29/182.8 |
| 3,894,673 | | 7/1975 | Lowder et al. | 228/122 |
| 3,923,558 | * | 12/1975 | Shapiro et al. | 148/32.5 |
| 3,960,518 | * | 6/1976 | Hall | 51/309 R |
| 4,018,576 | | 4/1977 | Lowder | 51/309 |
| 4,116,688 | * | 9/1978 | Kaarlela | 75/229 |
| 4,471,026 | * | 9/1984 | Nicholas et al. | 428/450 |
| 4,968,326 | | 11/1990 | Wiand | 51/293 |
| 5,087,529 | * | 2/1992 | Engel et al. | 428/552 |
| 5,102,621 | * | 4/1992 | Sara | 420/470 |
| 5,308,367 | | 5/1994 | Julien | 51/293 |
| 5,492,771 | | 2/1996 | Lowder et al. | 428/565 |
| 5,518,519 | * | 5/1996 | Kondoh et al. | 75/231 |
| 5,762,660 | * | 6/1998 | Makowiecki et al. | 51/295 |
| 5,832,360 | * | 11/1998 | Andrews et al. | 428/552 |
| 5,846,269 | * | 12/1998 | Shiue et al. | 51/295 |

FOREIGN PATENT DOCUMENTS

| | | | | |
|---|---|---|---|---|
| 1086509 | | 9/1980 | (CA) | B24D/3/10 |
| 480878 | | 8/1991 | (EP) | B24D/3/06 |
| 1305689 | * | 2/1973 | (GB) . | |
| 61-136605 | * | 6/1986 | (JP) . | |
| 4-220195 | * | 8/1992 | (JP) . | |

OTHER PUBLICATIONS

A.D. Merriman, "A Dictionary of Metallurgy", MacDonald&Evans, Ltd., 1958, p. 25, Nov. 1958.*

(List continued on next page.)

*Primary Examiner*—Deborah Jones
*Assistant Examiner*—Michael Lavilla
(74) *Attorney, Agent, or Firm*—Mary E. Porter

(57) ABSTRACT

A bond for a metal single layer abrasive tool can be easily chemically and electrochemically stripped from the metal core of a recovered used tool to facilitate reuse of the core. Relative to conventionally bonded tools, the speed of stripping the novel bond is quick, and the stripped core has a smooth, clean surface which needs only minimal mechanical repair prior to reuse. The composition of the novel bond consists essentially of copper, tin and titanium. It can be brazed at temperatures below diamond graphitization and is chemically compatible with diamond. Hence, the bond is particularly useful for the manufacture of large diameter, superabrasive metal single layer abrasive wheels employed in the construction industry. The bond can be applied to the cutting surface of the abrasive tool as a uniform mixture of bronze alloy, titanium compound and copper powders. The powders may be mixed with a liquid vehicle and applied as a paste. The method of brazing the bond incorporates heating the bond composition to a temperature at most about 880° C. to melt the bronze alloy and titanium compound components, and raising the temperature to at least about 900° C. to dissolve the copper. The bond can also include an about 10–200 μm thick barrier layer of copper coating the cutting surface between the core and the bond composition.

10 Claims, 4 Drawing Sheets

OTHER PUBLICATIONS

R.B. Aronson, "CBN Grinding—a tempting technology", Manufacturing Engineering, Feb. 1994, p. 35.

J.A. Borkowski and A.M. Szymanski, "Uses of Abrasives and Abrasive Tools", Ellis Horwood Ltd., 1992 (No Month).

M. M. Schwartz, "Brazing", ASM International, 1987 (No Month).

G. Humpston and D.M. Jacobson, "Principles of Soldering and Brazing, " ASM International, 1993. (No Month).

M.M. Schwartz, "Ceramic Joining, " ASM International, 1989 (No Month).

"ASM Handbook, " vol. 6, ASM International, 1993 (No Month).

R.W.K. Honeycombe, Steels–Microstructure and Properties, 1996 (No Month).

J.F. Elliott and M. Gleiser, Thermochemistry for Steelmaking, vol. 1., 1960 (No Month).

H.K. Lee and J.Y. Lee, "Decomposition and Interfacial Reaction in Brazing of SiC by Copper–Based Active Alloys, " Journal of Materials Science Letters, 11, 1992, p. 550–553 (No Month).

J.Wilks and E. Wilks, "Properties and Applications of Diamond, " Butterworth–Heinemann Ltd., 1991 (No Month).

Warnecke, G. and Wimmer J., "Stock Removal and Wear in Deep Grinding High–Performance Ceramics, " Industrial Diamond Review, 55(566), pp. 126–132, 1995 (No Month).

Evens et al., "The Wetting and bonding of diamonds by copper–tin–titanium alloys, " Ind. Diamond Rev. Sep. 1977, pp. 306–9, 1977.*

Kizikov et al., "Study of the Sintering of Diamonds with a Copper–Tin–Titanium Alloy, " Sinteticheskie Almazy, No. 2, pp. 13–17, No Month 1973 1973.*

Kizikov et al., "A Study of Cu–Sn–Ti Alloys used as Binders for a Diamond–Abrasive Tool, " Metals Technol. and Heat Treatment of Metals, No. 1, No Month 1975, pp. 57–62, 1975.*

Dvorakova, "Contribution to Study of Properties of a metal solder consisting of Cu, 20% by weight Sn, and 10% bt weight Ti, " Kovove materialy, vol. 5, No. 23, No Month 1985, pp. 629–38, 1985.*

* cited by examiner

REMOVABLE BOND FOR ABRASIVE TOOL

FIELD OF THE INVENTION

This invention relates to a bond for attaching grit to the core of an abrasive tool. More specifically it relates to a bond which can be easily removed to facilitate reuse of the core.

BACKGROUND AND SUMMARY OF THE INVENTION

Industrial abrasive tools typically include abrasive grains of a hard substance affixed to a rigid core. The core can be adapted to be manually or power driven in moving contact with a work piece to grind, cut, polish or otherwise abrade the work piece to a desired shape. The abrasive grains are usually attached to the core by a material sometimes called a bond.

The cutting ability of abrasive tools generally diminishes with continued use. Ultimately, a tool wears out completely so as to become altogether ineffective for further use. At such time, the worn tool should be replaced with a fresh one. Often the reduced cutting ability is due to causes such as excessive dulling and loss of the abrasive grit. The grit can be lost when the bond wears away or fractures through contact with the work piece. In many cases, only the abrasive and bond are affected by wear and the core remains substantially intact.

The need to replace worn out abrasive tools is important in certain applications such as construction material grinding and cutting. The materials being cut typically include metals, natural stone, granite, concrete and ceramics. These materials tend to wear out tools relatively quickly, and even the most durable abrasive tools which incorporate superabrasive grits, such as diamond and cubic boron nitride ("CBN"). Additionally, construction material abrasive tools are frequently quite large. Abrasive wheels of up to several feet in diameter for cutting asphalt, concrete and other roadway materials are not uncommon. The cost of replacing such tools can be quite high.

To reduce replacement cost, it is usually possible to recondition the core recovered from a worn out tool. This is generally accomplished by removing any residual bond and grit on the core, repairing insubstantial structural defects in the core and applying a new cutting surface of abrasive grit and bond. Removal of bond and grit from recovered abrasive tools is sometimes referred to as stripping.

Many techniques such as scouring and heating also may be used to strip recovered cores. Abrasive tools which employ a metal bond are usually stripped by a combination of chemical and electrochemical processes. That is, the tool is immersed in a chemical bath which is selectively corrosive to the composition of the bond. A suitable electrical voltage may be applied in a manner which further strips the bond from the core by reverse electroplating.

While significant for many abrasive tool types, the ability to strip the core is particularly important in the development of bonds for so-called Metal Single Layer ("MSL") type tools. MSL tools basically are made by applying a thin coating of a bonding material brazing paste to the cutting surface of the core. Grit particles are usually either placed individually or sprinkled on the paste. Finally, the paste is brazed by heat treatment to form a metal alloy bond.

Nickel has been used in traditional bonds for electroplated tools and it can be readily stripped from the core. However, a nickel plated bond is not very suitable for MSL tools because such bond generally needs to be plated onto the core with a plating bath. Plating baths use large volumes of abrasive grit dispersed in the plating liquid. In high performance applications, the grit is frequently diamond or CBN which causes the plating bath to be excessively expensive to maintain. Alternatively, nickel-based bonds can be brazed, but at very high temperatures, typically well above 1000° C. Those temperatures can cause diamond to graphitize and even to distort the sometimes thin cross-sectioned, metal core.

Alloys which include titanium have gained popularity in the field of bonds for MSL tools. Wesgo, Inc. of Belmont, Calif. offers a bond based on copper-silver eutectic with 4.5 wt % titanium under the tradename Ticusil®. Although this product provides an easily stripped bond, it is relatively expensive due to the silver content, and its performance in service is moderate.

A preferred titanium-containing MSL bond alloy has the composition 70Cu/21Sn/9Ti (wt %). Unfortunately, such bond is not readily strippable by chemical and electrochemical methods. Cu/Sn/Ti-containing bond compositions are thought to strip poorly because (a) tin-bearing intermetallic phases within the bond are resistant to corrosion by stripping chemicals, and (b) a Ti/Fe/Cu/Sn intermetallic phase is formed which strongly adheres the bond to the core. Tin and titanium are melting point depressants for the alloy and titanium reacts with carbon which beneficially causes the molten bond to wet diamond grit during brazing. Therefore, simply reducing the amount of tin and titanium in the composition to improve stripping ability is not acceptable.

A Cu/Sn/Ti bond for brazing superabrasive grit to an MSL abrasive tool is highly desirable. Accordingly, the present invention provides a removable bond for a predominantly iron core abrasive tool comprising a bond composition consisting essentially of (a) about 62–92 wt % bronze alloy powder containing about 10–30 wt % tin;

(b) about 5–25 wt % copper powder; and (c) about 3–12 wt % titanium;

wherein the bond is substantially free of voids and exists as a mixture consisting essentially of a copper-rich alloy phase and a copper/tin/titanium intermetallic phase.

This invention additionally provides a process for making a removable bond for a predominantly iron core abrasive tool comprising the steps of:

(1) mixing to a uniform dispersion, a powder of bronze alloy consisting essentially of about 10–30 wt % tin and a complementary amount of copper; a powder of titanium hydride; and a copper powder in proportions effective to obtain a bond composition consisting essentially of
   (a) about 70–90 wt % copper;
   (b) about 15–21 wt % tin; and
   (c) about 3–12 wt % titanium;

(2) heating the bond composition to a bronze melting temperature not exceeding about 880° C.;

(3) holding the bond composition at the bronze melting temperature for a melting duration effective to completely liquefy the bronze alloy and titanium hydride;

(4) raising the temperature to a copper dissolution temperature of at least about 900° C.; and (5) holding the bond composition at the copper dissolution temperature for a dissolving duration effective to substantially completely dissolve the copper powder in the copper-rich alloy phase.

Still further the present invention provides a process for making a metal single layer abrasive tool which incorporates the novel bond.

There is also provided a metal single layer abrasive tool which incorporates the novel bond. Also according to the present invention there is provided a metal single layer abrasive tool which includes an about 10–200 μm thick barrier layer of copper between the core and a bond composition containing copper, tin and titanium. The present invention additionally provides a process for making a metal single layer abrasive tool comprising the steps of:

(1) coating a cutting surface of a predominantly iron core of the abrasive tool with an about 10–200 μm thick barrier layer of copper;

(2) mixing to a uniform dispersion
  (A) a bond composition comprising copper, tin and titanium; and
  (B) an effective amount of a liquid binder to form a paste (3) coating the barrier layer with a layer of the paste;

(4) depositing a substantially single layer of abrasive grains on the paste; and (5) heating the bond composition to a temperature effective to braze the abrasive grains to the abrasive tool.

DETAILED DESCRIPTION

Figure 1:
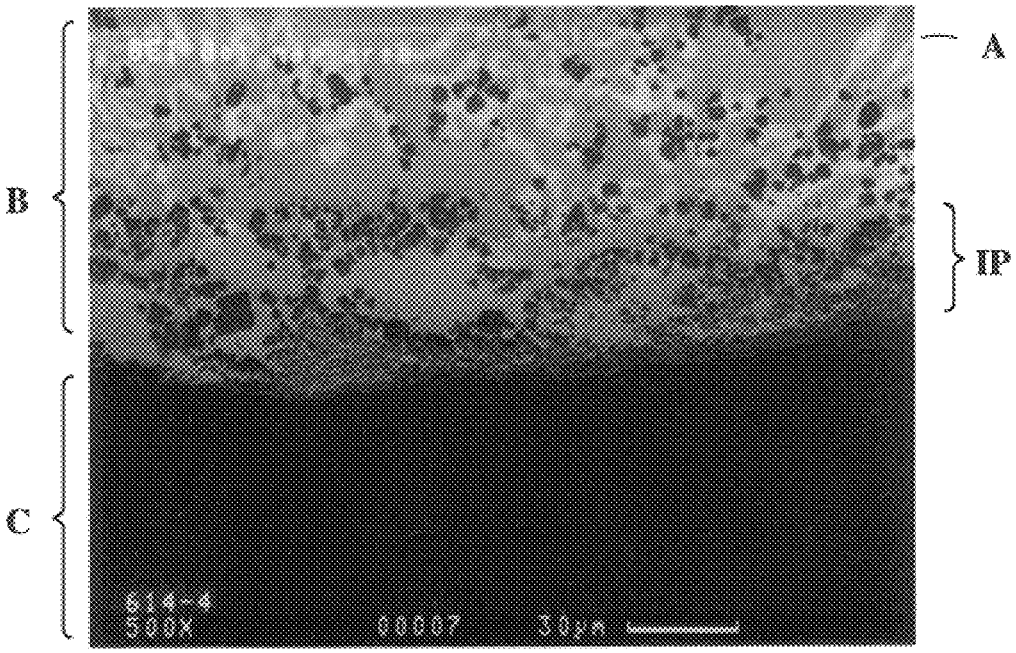
FIG. 1 is a scanning electron microscope photomicrograph of the interface between a conventional 70Cu/21Sn/9Ti bond and a steel core.

In one form thereof, the invention is a removable bond for a predominantly iron core abrasive tool which includes a bond composition being largely copper, tin and titanium. Occasionally herein, the term "bond composition" is used to designate the composition of the mixture of components which constitute the bond. The term "bond" means the fused bond after heat or other treating of the bond composition to fix abrasive grains to the tool. As used herein, the term "predominantly iron core" means a core of metal composition in which elemental iron is a substantial component. Predominantly iron core is intended to embrace cores of elemental iron and iron alloys, such as carbon steel and stainless steel, which may contain minor but significant proportions of nickel, chrome, molybdenum, chromium, vanadium, tungsten, silicon, manganese and mixtures thereof, for example.

The bond composition is preferably about 74–80 wt % copper, about 15–18 wt % tin gand about 5–8 wt % titanium, more preferably, about 74.6–76.4 wt % copper, about 16.4–17.7 wt % tin and about 7.2–7.7 wt % titanium. The bond composition may also include minor amounts of additional components such as elemental carbon and zirconium. Generally, such additional components can be present at most to about 5 wt %, except that elemental carbon can be present at most to about 0.5 wt %.

Preferably, the copper, tin and titanium are added into the bond as three ingredients, namely, bronze alloy, titanium hydride and elemental copper. The bronze alloy consists essentially of about 10–30 wt % tin and a complementary amount of copper. Preferably, the bronze alloy is about 23–25 wt % tin.

The titanium ingredient preferably contains titanium in a form which can react during brazing with a superabrasive, particularly diamond. This reactivity improves the ability of the molten brazing composition to wet the surface of the abrasive grains. The resulting enhanced compatibility between bond and superabrasive is believed to promote adhesive bond strength. The titanium can be added to the mixture either in elemental or compound form. Elemental titanium reacts with water at low temperature to form titanium dioxide and thus becomes unavailable to react with diamond during brazing. Therefore, adding elemental titanium is less preferred when water, which sometimes can be a constituent of the liquid binder, is present. If titanium is added in compound form, the compound should be capable of dissociation during the brazing step to permit the titanium to react with the superabrasive. Preferably titanium is added to the bond material as titanium hydride, $TiH_2$, which is stable up to about 600° C. Above about 600° C., titanium hydride dissociates to titanium and hydrogen.

The third ingredient of the bond is copper. As will be explained below, it is intended to dissolve the copper in the bronze-dominated, copper-rich alloy phase during brazing. Thus it is important that the copper ingredient be added in a form readily capable of such dissolution. If added as a copper alloy with a diluent, such as aluminum, lead, nickel, and silver, the copper in the alloy should able to easily re-dissolve in the bronze phase. Preferably, the copper ingredient is elemental copper.

Generally, the bronze alloy, titanium and copper ingredients are supplied in powder form. Particle size of the powder is not critical, however powder smaller than about 325 U.S. Standard sieve mesh (44 μm particle size) is preferred. The bond composition is prepared by mixing the ingredients, for example, by tumble blending, until the components are dispersed to a uniform concentration.

The dry powder bond composition can be mixed with a low viscosity, liquid binder. The binder is added to the powdered ingredients in effective proportion to form a viscous, tacky paste. In paste form, the bond composition can be accurately dispensed and should be adhesive to the cutting surface of the core and to the abrasive grains. Preferably, the bond composition paste should have the consistency of tooth paste. The binder should be sufficiently volatile to substantially completely evaporate and/or pyrolyze during brazing without leaving a residue that might interfere with the function of the bond. Preferably the binder will vaporize below about 400° C. However, the binder volatility should be low enough that the paste remains fluid and tacky at room temperature for a reasonable time ("drying time") to apply the bond composition and abrasive to the core and to prepare the tools for brazing. Preferably the drying time should be about 1–2 hours. Liquid binders suitable to meet the parameters of the novel bond composition are commercially available. Representative paste-forming binders suitable for use in the present invention include Braz™ gel from Vitta Company; and Lucanex™ binder from Lucas Company. The latter is a proprietary composition and may need to be specially obtained as a paste already mixed by the vendor with bond composition components. The binder can be blended with the powders by many methods well known in the art such as ball milling. The order of mixing powders and liquid binder is not critical.

The paste is coated onto the core by any of the techniques well known in the art, such as brushing, spraying, doctoring or dipping the surface of the tool in the paste. For example, the paste can be coated onto the core with the aid of a turning machine. A layer of abrasive grains then is deposited on the coating of bond composition. The abrasive grains can be placed individually or sprinkled in a manner to provide even distribution over the cutting surface. The abrasive grains are deposited in a single layer, i.e., substantially, one grain thick. Particle size of the abrasive grains generally should be larger than 325 mesh, and preferably, larger than about 140 mesh. For tools intended to cut extremely hard work materials such as encountered in the construction industries, the abrasive grains preferably should be a superabrasive substance such as diamond and cubic boron nitride. Diamond is preferred.

The bond according to the present invention preferably is made by a multi-step brazing process. The brazing process has two basic elements. First, the bond composition is melted to liquefy the components other than the copper powder. Second the molten bond composition is heated to a higher, dissolution temperature to enable the copper to dissolve within and optionally, beneath the bronze alloy phase and forms a copper-rich phase between the active bond components and the core. It has been observed that such a multi-step brazing process provides a void-free, essentially two phase bond. That is, the bond exists as a substantially completely solid mixture consisting essentially of a copper-rich alloy phase and a copper/tin/titanium intermetallic phase. This morphology gives the bond improved toughness and strength as well as promotes the ability of the bond to readily strip from the core.

After the brazing paste and abrasive grains are applied to the cutting surface of the core, the bond composition is heated to the bronze melting temperature. The bronze melting temperature should not exceed about 880° C. to prevent the powdered copper from liquefying until the remaining components are fully molten. Preferably, the bronze melting temperature will be in the range of 850–870° C., and more preferably about 865° C. The brazing should be maintained at the bronze melting temperature for a duration sufficient to substantially completely melt the bronze alloy and titanium and to extensively wet the surface of the grains, particularly when a superabrasive is employed. Fifteen minutes at bronze melting temperature is often sufficient and thirty minutes is preferred.

Brazing is continued by raising the temperature to a dissolution temperature above the bronze melting temperature. At the dissolution temperature, the copper powder dissolves in the bronze alloy phase. The dissolution temperature should be at least about 900° C. It is recommended that the dissolution temperature not exceed about 950° C. because, such high temperatures generally are not necessary, the risk of graphitizing diamond increases and the core can be distorted at higher temperatures. The bond should be held at the dissolution temperature for a time sufficient to effectively complete dissolving the copper powder. In brazing wherein the temperature is raised rapidly from the bronze melting temperature to the dissolution temperature, the dissolving duration should be at least about 15 minutes, and preferably about 30 minutes. Satisfactory results are also obtained by gradually heating the bond composition to the dissolution temperature. The term "gradual heating" means that the temperature rises at most at about 1° C. per minute. Because the bond composition is subjected to longer heat aging at intermediate temperatures with gradual heating, the total time during which the bond composition is above 880° C. should be at least 30 minutes. Hence, gradual heating can effectively shorten the dissolving duration. That is, if the bond is gradually heated from 865° C. (bronze melting temperature) to 905° C. (dissolution temperature), the dissolving duration can be reduced to 5 minutes, because the heat aging from 880° C. to 905° C. will be 25 minutes.

In an important aspect of this invention it has been discovered that a thin barrier layer of copper between the core and the brazed Cu/Sn/Ti-containing bond promotes the ability to easily strip the bond. Without wishing to be bound by a particular theory, it is thought that copper and titanium in the bond and iron in the core normally will form an intermetallic phase at the core-bond interface during brazing. This intermetallic phase is very chemically stable and thus, makes stripping difficult. According to the present invention, however, a barrier layer of copper prevents the interfacial, intermetallic phase from forming.

A tool with a barrier layer can be fabricated by depositing a layer of copper on the cutting surface before applying the bond composition paste in advance of brazing. The barrier layer can be applied by any conventional technique for coating an iron article with copper, such as electroplating. Methods for coating steel with copper are disclosed by Cotell, et al., ASM Handbook, Vol. 5, Surface Engineering, ASM International, 1994. Generally, substantially all oxidation should be removed from both core and copper prior to coating. The minimum thickness of the barrier layer will be determined by the need to isolate the core from the bond so as to prevent an interfacial intermetallic phase from forming. Maximum thickness of the barrier layer is not critical, however, an excessively thick barrier will be wasteful of copper and therefore uneconomical. Also, thick barrier layers of copper may be too weak to withstand the severe environment encountered when cutting tough materials. Hence, the barrier layer can be in the range of about 10 $\mu$m–200 $\mu$m thick, and preferably, about 10 $\mu$m–50 $\mu$m.

The barrier layer of copper can be deployed to make a conventional Cu/Sn/Ti-containing bond easily strippable from a predominantly iron core. That is, the barrier layer will operate even if the components are not added as three ingredients in powder form according to this invention. Furthermore, the copper barrier layer technique should function even for a single step brazing process, i.e., in which the temperature is brought directly to the brazing temperature without holding at an intermediate, bronze melting temperature. Moreover, the barrier layer can be used in combination with the novel bond composition and multi-step brazing process described above to additionally enhance stripping capability. However, it is cautioned that gradual heating in the multi-step brazing process may prolong and promote dissolution of the copper barrier layer into the copper-rich bronze alloy phase. Such dissolution will consume copper from the barrier layer thereby potentially allowing the bond composition to breach the barrier and form an intermetallic phase with iron in the core. Therefore, a minimum barrier layer thickness of about 25 $\mu$m is preferred when a multi-step brazing process with gradual heating is used.

This invention is now illustrated by examples of certain representative embodiments thereof, wherein all parts, proportions and percentages are by weight unless otherwise indicated. All units of weight and measure not originally obtained in SI units have been converted to SI units.

EXAMPLES

Comparative Example 1

A metal single layer, diamond abrasive wheel was produced by brazing a bond composition of 70Cu/21Sn/9Ti in a single brazing step at 900° C. lasting 30 minutes. Prior to use, a portion of the core/bond interface of one side of the wheel was examined by scanning electron microscope. A photomicrograph is shown in FIG. 1. The bond exhibits regions of intermetallic phases (gray sections) interspersed among solid-appearing, bronze alloy phases ("A") throughout the bond ("B"). A region of intermetallic phase ("IP") predominates at the interface between the bond and the core ("C"). Several intermetallic sections were analyzed by X-ray diffraction which revealed the following analyses: $IP_a$= 10Cu/45Sn/35Ti/10Fe; $IP_b$=59Cu/35Sn/5Ti/1Fe; $IP_c$=10Cu/2Sn/29Ti/59Fe. By similar analysis, a bronze alloy phase was found to have 85Cu/15Sn composition.

Example 1 and Comparative Examples 2–4

Figure 2B:
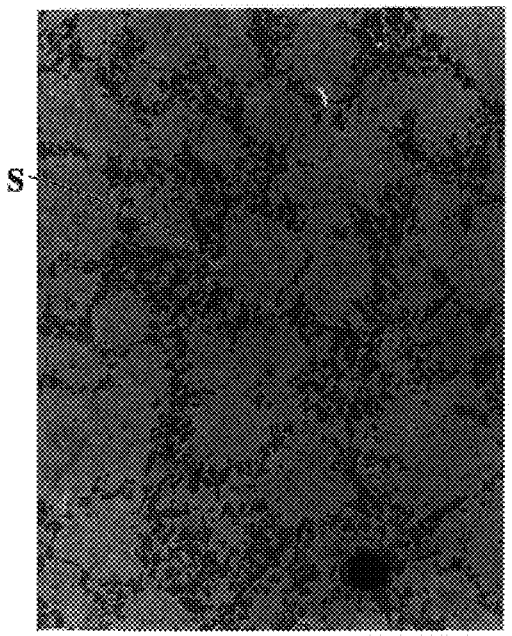
FIG. 2B is an optical microscope photomicrograph of a conventional bond from 71.4 wt % bronze powder (77Cu/23Sn), 7.2 wt % Ti $H_2$ powder, and 21.4 wt % copper powder brazed at 865° C.
Figure 2C:
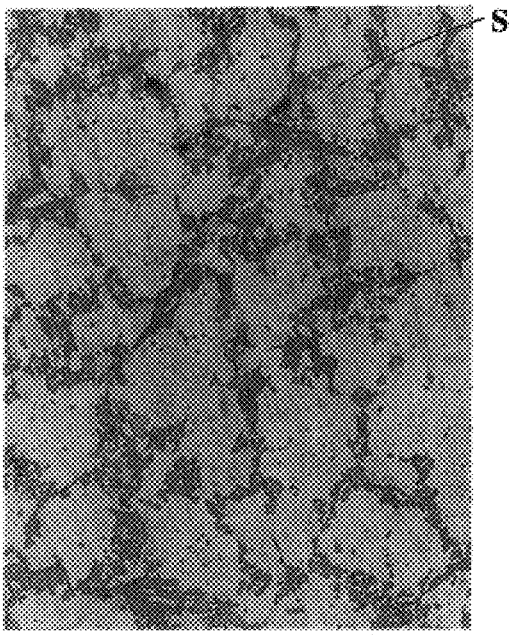
FIG. 2C is an optical microscope photomicrograph of a conventional bond from 71.4 wt % bronze powder (77Cu/23Sn), 7.2 wt % Ti $H_2$ powder, and 21.4 wt % copper powder brazed at 880° C.
Figure 2D:
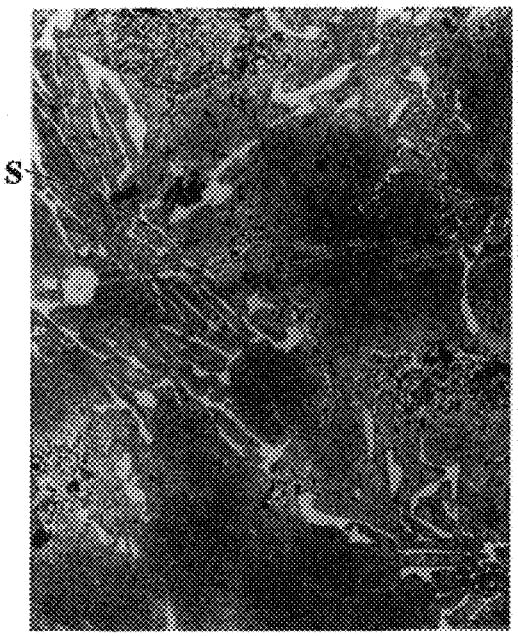
FIG. 2D is an optical microscope photomicrograph of a conventional bond from 71.4 wt % bronze powder (77Cu/23Sn), 7.2 wt % Ti $H_2$ powder, and 21.4 wt % copper powder brazed at 900° C.
Figure 2A:
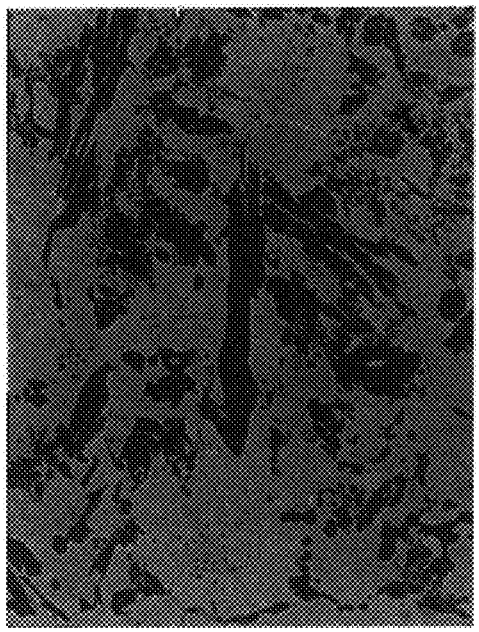
FIG. 2A is an optical microscope photomicrograph of a bond made according to the present invention from 71.4 wt % bronze powder (77Cu/23Sn), 7.2 wt % Ti $H_2$ powder, and 21.4 wt % copper powder.

A paste of 20 parts of Vitta Braz™ Binder Gel from Vitta Corporation, Bethel, Conn., and 80 parts of a bond composition containing 71.4% bronze powder (77Cu/23Sn) of 325 mesh from Connecticut Engineering Co., Newtown, Conn., 7.2% Ti $H_2$ powder of 325 mesh, and 21.4% 325 mesh copper powder from CERAC Co., Milwaukee, Wis., was prepared by mixing the ingredients until a uniform paste was obtained. The paste was coated onto a steel substrate and type IMG 40/50 diamond grains from Tomei Company were deposited in a single layer on the paste. The bond composition was brazed in two steps: (a) vacuum brazing step at 865° C. for 30 minutes; followed by (b) dissolution step at 900° C. for 30 minutes (Ex. 1). The structure was cut to expose a section which was photomicrographed using optical microscopy (FIG. 2A). Three bond compositions identical to Ex. 1 were prepared similarly. The bonds were vacuum brazed for 30 minutes in single temperature brazing processes, as follows: Comp. Ex. 2, 865° C. (FIG. 2B); Comp. Ex. 3, 880° C. (FIG. 2C); and Comp. Ex. 4, 900° C. (FIG. 2D).

FIGS. 2B, C, and D show that single step brazing of the powdered ingredients produces an inhomogenous bond. Spherical regions of undissolved copper powder ("S") and voids are evident in each of the comparative examples. In stark contrast, FIG. 2A shows a dramatic reduction of void content and undissolved copper plus the existence of only two phases, namely, a dark intermetallic phase and a somewhat lighter, much more prominent, bronze alloy phase.

Example 2 and Comparative Example 5

Figure 3A:
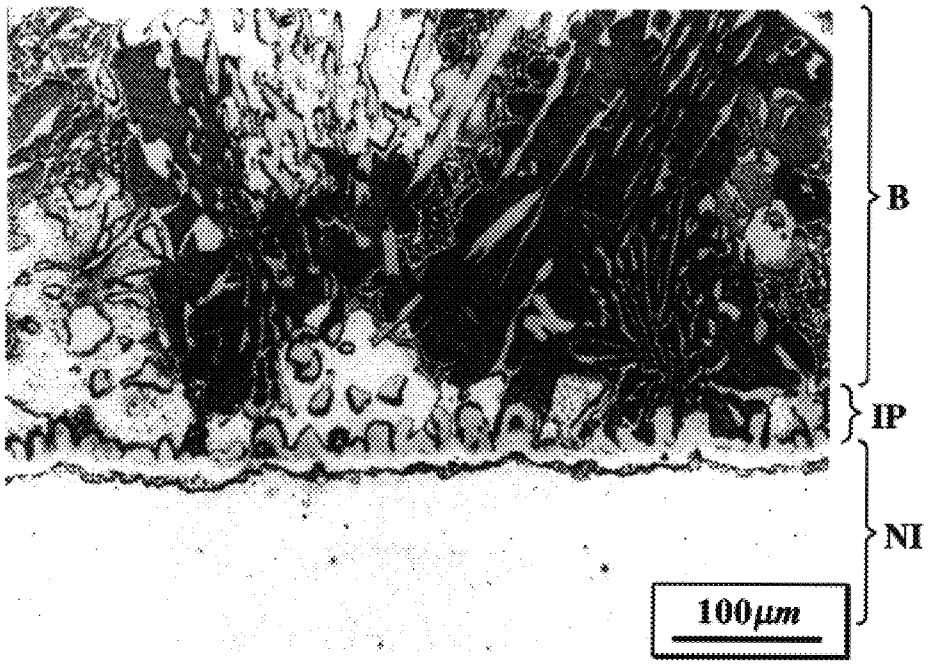
FIG. 3A is a magnified photograph of a section through a bond composition of 70Cu/21Sn/9Ti brazed onto a nickel barrier layer.
Figure 3B:
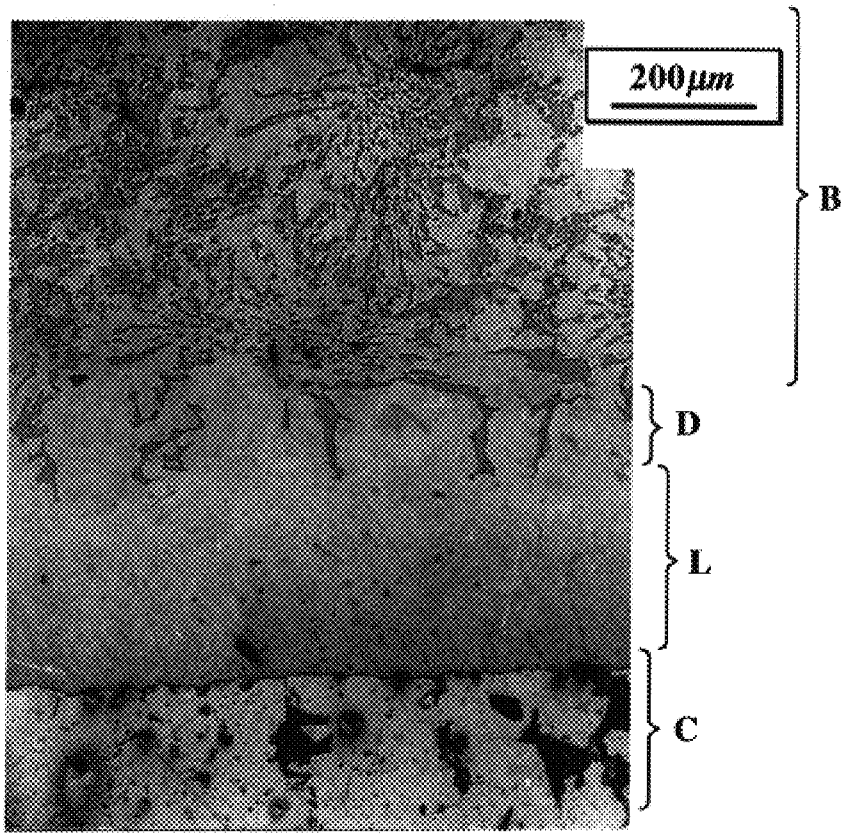
FIG. 3B is a magnified photograph of a section through a bond composition of 70Cu/21Sn/9Ti brazed onto a copper barrier layer according to this invention.

A steel crucible was plated with a 200 $\mu$m thickness coating of nickel metal. A paste composition of 70Cu/21Sn/9Ti80 parts and Vitta Braz Binder 20 parts was placed in the crucible. The crucible was fired at 865° C. for 30 in a vacuum furnace. After cooling the crucible was sectioned, the cross section was polished with fine alumina abrasive and washed. The cross section was examined under optical microscopy. A photograph was made of the section and scaled up by photographic enlargement as shown in FIG. 3A (Comp. Ex. 5). The procedure was repeated except that the crucible was coated with a 200 $\mu$m thickness coating of copper and the bond was brazed at 900° C. for 30 minutes. An enlarged photograph of a section view of the copper coated crucible is shown in FIG. 3B (Ex. 2).

FIG. 3A shows a dramatically variegated, brazed bond region ("B") disposed above the nickel coating layer ("NI"). A clearly defined, about 10–25 $\mu$m thickness intermetallic phase band ("IP") was formed between the bond and the nickel layer. Nickel is a poor choice for a barrier layer candidate because the intermetallic layer is chemically stable and will impede stripping of recovered cores. The interface is thought to be relatively brittle and therefore should reduce the strength of the bond during grinding. Four regions can be seen in FIG. 3B: the steel core ("C"), separated from the copper barrier layer ("L") by a sharp interface, the bronze alloy/intermetallic bond ("B") and an approximately 50 $\mu$m thick region ("D") between the bond and barrier layer in which some copper dissolved and enriched the bond. Because the bond composition was prevented from fully penetrating the barrier layer, no iron-containing intermetallic layer is produced between the bond and substrate.

Examples 3 and 4 and Comparative Examples 6 and 7

Four new metal single layer abrasive wheels were tested to determine the ease of stripping the bond from low carbon steel cores. Descriptions of the test wheels and results of the stripping tests are shown in Table I.

TABLE I

| | Ex. 3 | Ex. 4 | Comp. Ex. 6 | Comp. Ex. 7 |
|---|---|---|---|---|
| Core metal | low carbon steel | low carbon steel | low carbon steel | low carbon steel |
| Core Diameter, (cm) | 12.70 | 12.70 | 12.70 | 12.70 |
| Core thickness, (cm) | 0.635 | 0.635 | 0.635 | 0.635 |
| Abrasive type | 40/50 mesh IMG synthetic diamond | 40/50 mesh IMG synthetic diamond | 40/50 mesh IMG synthetic diamond | 40/50 mesh IMG synthetic diamond |
| Abrasive loading, (g/wheel) | 2.30 | 2.30 | 2.30 | 2.30 |
| Bond composition | 76.9 bronze[1]<br>7.7 $TiH_2$<br>15.4 Cu | 76.9 bronze[1]<br>7.7 $TiH_2$<br>15.4 Cu | 70 Cu<br>21 Sn<br>9 Ti | 59.1 Cu<br>17.7 Sn<br>9.6 Ti |

TABLE I-continued

| | | | | |
|---|---|---|---|---|
| | | | | 5.8 Zr<br>7.7 TiC<br>0.15 C |
| Barrier layer type | none | Cu | none | none |
| Barrier layer thickness, μm | — | 50 μm | — | — |
| Brazing conditions | 30 min. melt at 865 ° C.; heat 1 ° C./min to 895 ° C.; hold 5 min. | 30 min. melt at 865 ° C.; heat 1 ° C./min to 895 ° C.; hold 5 min. | 865 ° C. for 30 min. | 920 ° C. for 30 min. |
| Time in stripping bath (min.) | Weight loss (%) | | | |
| 83.00 | 0.473 | 0.127 | 0.0768 | 0.0512 |
| 164.00 | 0.601 | 0.430 | 0.115 | 0.064 |
| 260.00 | 0.831 | 0.974 | 0.218 | 0.141 |
| 303.00 | 0.985 | 1.278 | 0.294 | 0.166 |
| 447.00 | 0.997 | 1.733 | 0.371 | 0.256 |
| 536.00 | 1.113 | 1.822 | 0.397 | 0.269 |
| 595.00 | 1.113 | 1.948 | 0.422 | 0.307 |
| 775.00 | —[2] | —[2] | 0.474 | 0.346 |

[1]77 Cu/23 Sn
[2]stripping completed

Each wheel of Table I was immersed continuously at 25° C. in ENSTRIP 5000, stripping solution from Enthone-OMI, Inc., New Haven, Conn. Weight loss as a percentage of initial weight was measured from time to time and recorded. Visual examination of Example 4 core showed that the former abrasive surface was smooth and free of bond and abrasive residue at the end of the test. Both Ex. 3 and 4 cores were in acceptable condition after 10 hours of chemical stripping to be reused without machining to remove additional bond/abrasive. Rate of weight loss for Ex. 3 and 4 was in each case much faster than for the comparison example wheels. Each of Comparison Example 6 and 7 continued to lose weight at slow rate after 775 minutes in the stripping bath. Visual inspection of the comparison examples showed that significant amounts of grit and bond residue remained on the cutting surface at conclusion of the test.

Figure 4:
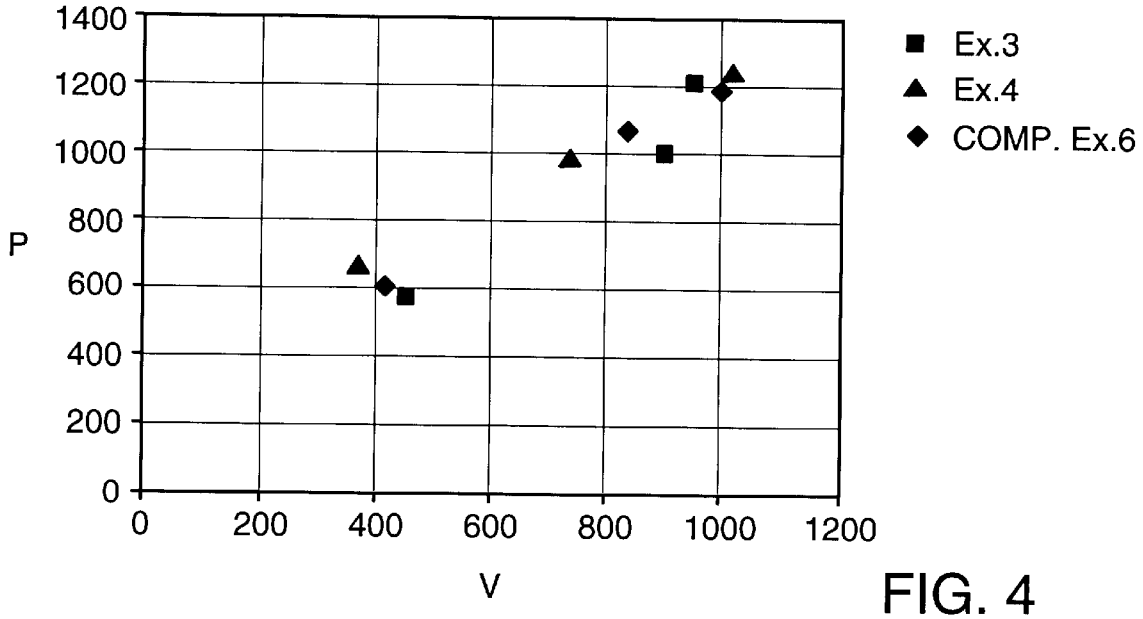
FIG. 4 is a plot of power, P (W) vs. accumulated volume cut, V ($cm^3$) for several abrasive wheels.
Figure 5:
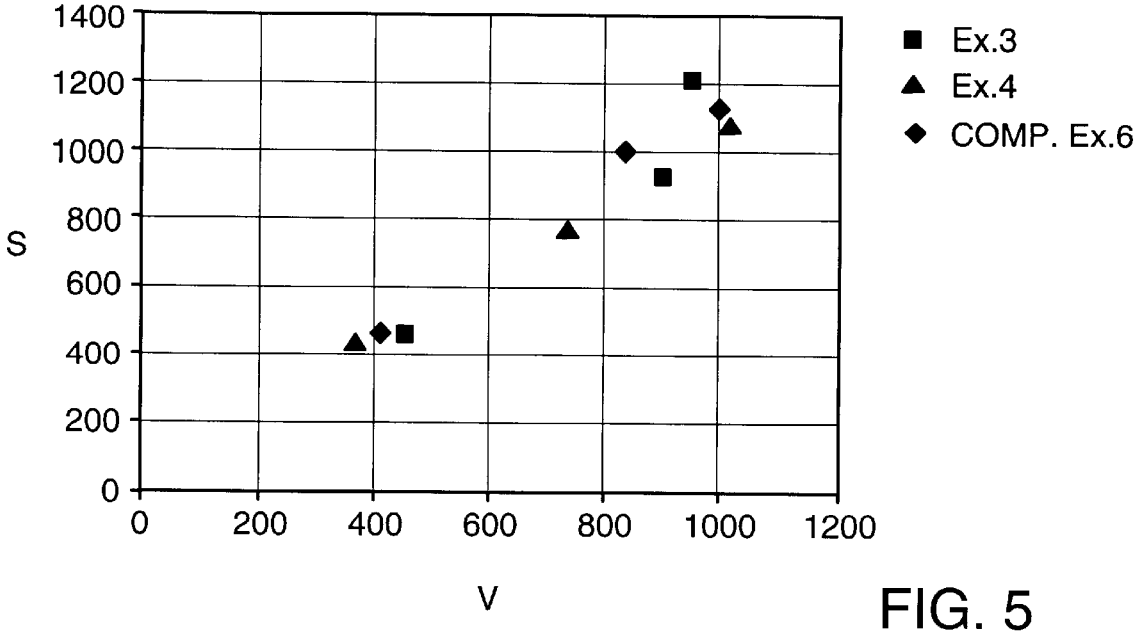
FIG. 5 is a plot of normal stress, S (N/cm) vs. accumulated volume cut, V ($cm^3$) for several abrasive wheels.

Wheels of Examples 3 and 4 and Comparative Example 6 were subjected to the following grinding tests. Each wheel was used to grind 23.32 cm×10.16 cm×2.54 cm, high density 99.5% alumina blocks from Coors Ceramics Company, Golden, Colo. Wheel surface speed was 25.4 m/s, longitudinal speed was 2.54 cm/s, transverse feed was 2.54 mm, and depth of cut was 0.432 mm. Power consumption, P, in watts and normal stress needed to cut, S, in newtons per centimeter were measured periodically and each are plotted against accumulated volume cut V, in $cm^3$ in FIGS. 4 and 5, respectively. These plots show that the novel abrasive wheels fabricated with strippable bonds according to the present invention performed similarly to a control wheel without a strippable bond. Additionally, the primary failure mode was observed to be fracture and flattening of the diamond grains. Diamond debonding was very limited. Stereo-optical microscope analysis indicated that less than five grains per wheel were lost at failure which was defined as occurring when normal stress increased to 1139 N/cm and/or the wheel stopped grinding. From these tests it was concluded that diamond grains were well bonded by the novel bonds and that the wheels made in accordance with this invention perform favorably relative to production quality wheels made with a high quality, durable bond alloy.

What is claimed is:

1. A metal single layer abrasive tool comprising:

(a) a predominantly iron core;

(b) a single layer of abrasive grit; and (c) a bond for adhering the abrasive grit to the iron core;

wherein the bond is substantially free of voids, and the bond consists essentially of a mixture of a copper-rich bronze alloy phase and an intermetallic phase consisting essentially of copper/tin/titanium; and the bond is made with a braze consisting essentially of (i) about 63 to about 92 wt % bronze alloy, the bronze alloy containing about 10 to about 30 wt % tin;

(ii) about 5 to about 25 wt % copper; and (iii) about 3 to about 12 wt % titanium.

2. The invention of claim 1 wherein the braze is about 74.6 to about 76.4 wt % copper, about 16.4 to about 17.7 wt % tin and about 7.2 to about 7.7 wt % titanium.

3. The invention of claim 1 wherein the abrasive grit is a superabrasive selected from the group consisting of diamond, cubic boron nitride and a mixture of them.

4. The invention of claim 1 wherein the braze is a mixture of a powder of bronze alloy consisting essentially of about 10 to about 30 wt % tin and a complementary amount of copper; a powder of titanium hydride; and a copper powder.

5. A metal single layer abrasive tool comprising:

(a) a predominantly iron core;

(b) a barrier layer of copper about 10 to about 200 μm thick on a cutting surface of the abrasive tool;

(c) a single layer of abrasive grit; and (d) a bond for adhering the single layer of abrasive grit to the barrier layer of copper;

wherein the bond consists essentially of:

(a) about 70 to about 90 wt % copper;

(b) about 15 to about 21 wt % tin; and (c) about 3 to about 12 wt % titanium.

6. The invention of claim 5 wherein the bond is substantially free of voids and exists as a mixture of a copper-rich bronze alloy phase and a copper/tin/titanium intermetallic phase.

7. The invention of claim 6 wherein the bond is about 74.6 to about 76.4 wt % copper, about 16.4 to about 17.7 wt % tin and about 7.2 to about 7.7 wt % titanium.

8. The invention of claim 6 wherein the abrasive grit is a superabrasive selected from the group consisting of diamond, cubic boron nitride and a mixture of them.

9. The invention of claim 6 wherein the bond is a mixture of a powder of bronze alloy consisting essentially of about 10 to about 30 wt % tin and a complementary amount of copper; a powder of titanium hydride; and a copper powder.

10. The invention of claim 6 wherein the barrier layer of copper is at least about 25 $\mu$m thick.

* * * * *